US007572084B2

(12) United States Patent
Robertson et al.

(10) Patent No.: US 7,572,084 B2
(45) Date of Patent: Aug. 11, 2009

(54) PRECAST ARCH STRUCTURE WITH SKEWED ENDS

(75) Inventors: David G. Robertson, Perrin, TX (US); John M. Ogorchock, Spring, TX (US)

(73) Assignee: Tricon Precast, Ltd., Houston, TX (US)

( * ) Notice: Subject to any disclaimer, the term of this patent is extended or adjusted under 35 U.S.C. 154(b) by 56 days.

(21) Appl. No.: 11/412,769

(22) Filed: Apr. 27, 2006

(65) Prior Publication Data

US 2007/0253776 A1 Nov. 1, 2007

(51) Int. Cl.
*E04B 1/32* (2006.01)

(52) U.S. Cl. ..... 405/126; 14/24; 52/86

(58) Field of Classification Search ..... 405/124–126, 405/119; 14/24, 26, 74.5, 73, 77.1; 52/86, 52/88, 89

See application file for complete search history.

(56) References Cited

U.S. PATENT DOCUMENTS

| | | | | |
|---|---|---|---|---|
| 2,478,421 | A * | 8/1949 | Pedersen | 52/726.1 |
| 4,537,529 | A | 8/1985 | FitzSimmons | |
| 4,558,969 | A | 12/1985 | FitzSimmons | |
| 4,595,314 | A | 6/1986 | Lockwood | |
| 4,687,371 | A | 8/1987 | Lockwood | |
| 4,797,030 | A | 1/1989 | Lockwood | |
| 4,854,775 | A | 8/1989 | Lockwood | |
| 4,993,872 | A | 2/1991 | Lockwood | |
| 5,836,717 | A | 11/1998 | Bernini | |
| D406,902 | S | 3/1999 | Lockwood | |
| D426,321 | S | 6/2000 | Lockwood | |
| 6,094,881 | A | 8/2000 | Lockwood | |
| 6,243,994 | B1 | 6/2001 | Bernini | |
| 6,434,892 | B1 | 8/2002 | Heierli | |
| 6,640,505 | B1 | 11/2003 | Heierli | |
| D484,610 | S | 12/2003 | Lockwood | |
| 6,719,492 | B1 | 4/2004 | Heierli | |
| D490,533 | S | 5/2004 | Lockwood | |
| 6,854,928 | B2 | 2/2005 | Lockwood | |
| 6,922,950 | B2 | 8/2005 | Heierli | |

(Continued)

OTHER PUBLICATIONS

Web page of photographs of precast concrete arch structure. printed date not legibile.

(Continued)

*Primary Examiner*—Sunil Singh
(74) *Attorney, Agent, or Firm*—Polasek, Quisenberry & Errington, LLP

(57) ABSTRACT

A skewed end assembly for connection to an arch culvert structure is provided. The assembly may generally include an arch-shaped inner skewed panel and a wedge member having a partially arch-shaped profile adapted for engagement with the inner skewed panel. The inner skewed panel may include a ledge that may include a plurality of threaded anchors. The wedge member may include a lip adapted for engagement with the ledge. The lip may include a plurality of apertures for receiving a plurality of threaded connectors adapted for threadable engagement with the corresponding threaded anchors in the ledge. Two assemblies, each comprising an inner skewed panel and a wedge member, are placed at opposed ends of an arch-shaped bridge or culvert structure to provide generally co-planar skewed ends to the structure such that it may be positioned at an angle in relation to a roadway such that the skewed ends are generally parallel to the roadway.

20 Claims, 3 Drawing Sheets

U.S. PATENT DOCUMENTS

| | | | |
|---|---|---|---|
| D511,215 | S | 11/2005 | Vaia |
| D511,387 | S | 11/2005 | Beach |
| 6,962,465 | B2 | 11/2005 | Zax et al. |
| D512,513 | S | 12/2005 | Wasniak et al. |
| 6,988,337 | B1 | 1/2006 | Heierli |
| D514,706 | S | 2/2006 | Beach |
| 7,001,110 | B2 | 2/2006 | Lockwood |
| 7,114,305 | B2 | 10/2006 | Heierli |
| 7,137,756 | B1 * | 11/2006 | Jones ..... 405/126 |

OTHER PUBLICATIONS

Enlarged photograph from web page of photographs of precast concrete arch structure, showing date of Jul. 27, 2000.

* cited by examiner

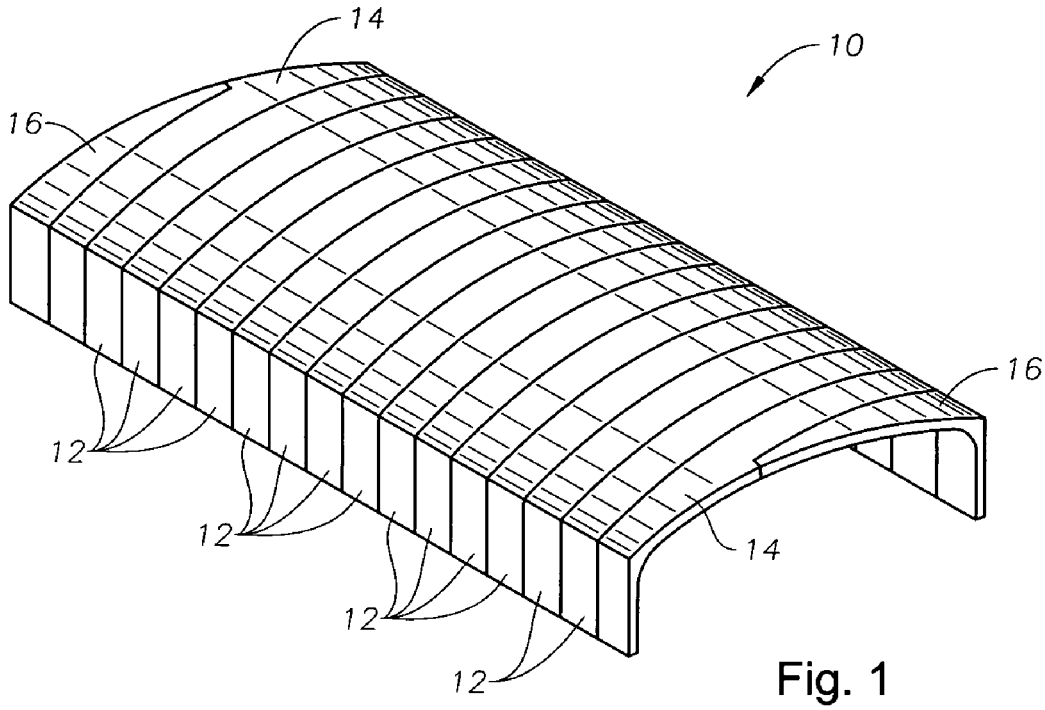
Fig. 1
Fig. 2
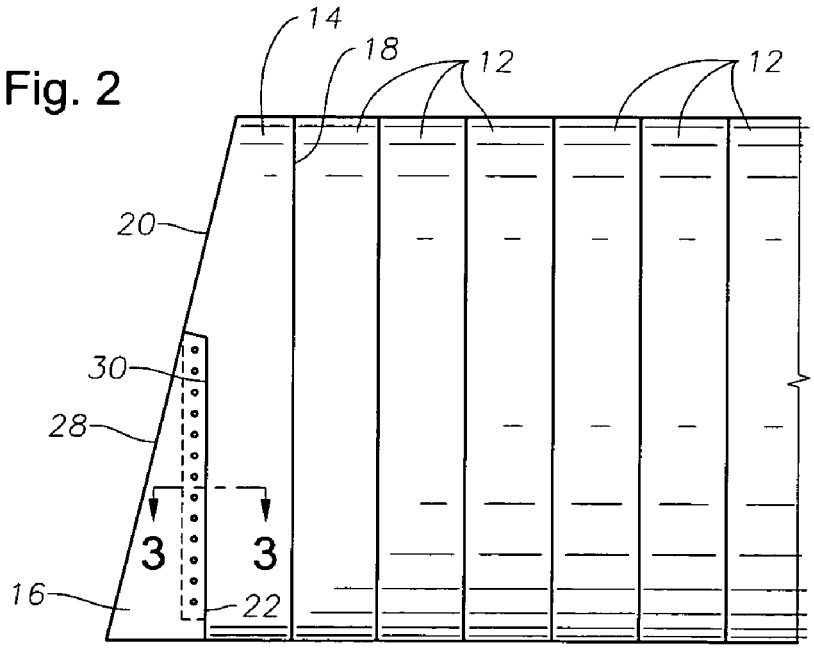

Fig. 3
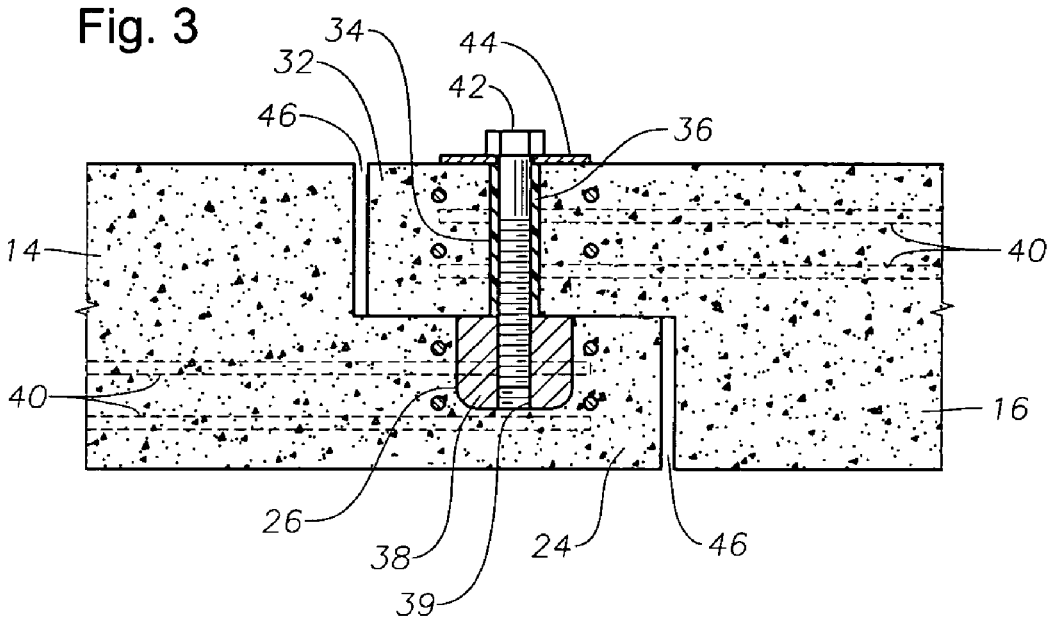
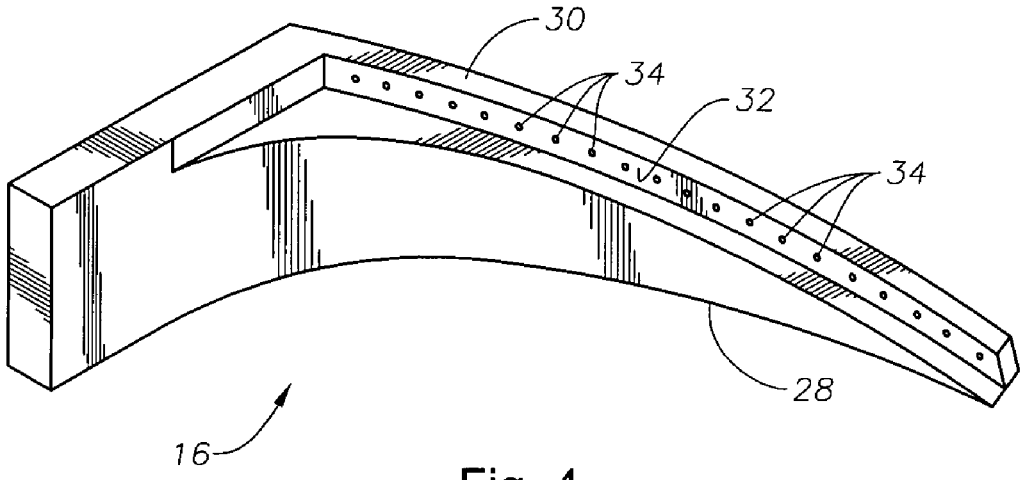
Fig. 4

PRECAST ARCH STRUCTURE WITH SKEWED ENDS

BACKGROUND OF THE INVENTION

1. Field of the Invention

The present invention generally pertains to arch structures used in the road construction industry, and more particularly to precast concrete arch structures having skewed or angled ends.

2. Description of the Related Art

It is known within the road construction industry to construct precast concrete arch-shaped units that are positioned upon a concrete footing and stacked next to one another in abutting relationship to form a bridge or culvert structure. Examples of these types of arch structures are disclosed in a number of U.S. patents, including, for example, U.S. Pat. No. 4,595,314 to Lockwood, U.S. Pat. No. 4,687,371 to Lockwood, U.S. Pat. No. 4,797,030 to Lockwood, U.S. Pat. No. 4,854,775 to Lockwood, and U.S. Pat. No. 4,993,872 to Lockwood. The bridge structures as illustrated in these patents are positioned such that the longitudinal axis of the arch bridge structure is generally perpendicular to the centerline of the roadway. Stated differently, the opposed ends of the bridge structure are generally parallel to the roadway. It is not uncommon, however, for the road design to call for the bridge structure to be positioned at an angle in relation to the roadway. If the structures as illustrated in the above patents are positioned at an angle, however, the opposed ends of the structure will not be parallel to the roadway. As such, as will become apparent from the following description and discussion, the present invention has been conceived and developed to provide an arched bridge structure in which the bridge structure itself is positioned at an angle relative to the roadway, but in which the opposed ends of the arch structure are generally parallel to the roadway.

SUMMARY OF THE INVENTION

In one aspect, the present invention may be a skewed end assembly for connection to an arch culvert structure comprising: an inner skewed panel having an arch-shaped side profile, an inner edge, an outer skewed edge disposed at an angle in relation to the inner edge, an outer mating edge that is generally parallel to the inner edge, and a ledge; and a wedge member having a partially arch-shaped side profile, an outer skewed edge, an inner mating edge and a lip adapted for engagement with the ledge on the inner skewed panel. Another feature of this aspect of the present invention may be that the ledge includes a plurality of bore holes and the lip includes a plurality of apertures adapted for alignment with the bore holes in the ledge, and further include a plurality of connectors disposed through the apertures in the lip and into the corresponding bore holes in the ledge. Another feature of this aspect of the present invention may be that the assembly further includes a plurality of cylinders disposed within corresponding apertures in the lip. Another feature of this aspect of the present invention may be that each cylinder is a section of PVC pipe. Another feature of this aspect of the present invention may be that the assembly further includes a plurality of threaded anchors disposed within corresponding bore holes in the ledge, and wherein each connector is a bolt adapted for threadable engagement with a corresponding threaded anchor. Another feature of this aspect of the present invention may be that the outer skewed edge on the inner skewed panel and the outer skewed edge on the wedge member are substantially co-planar when the inner skewed panel and the wedge member are in abutting relationship with the lip engaged to the ledge. Another feature of this aspect of the present invention may be that the inner edge of the inner skewed panel is adapted for abutting a corresponding edge of an arch-shaped culvert section in the arch culvert structure. Another feature of this aspect of the present invention may be that the arch-shaped profile of the inner skewed panel matches a corresponding arch-shaped profile of an arch-shaped culvert section in the arch culvert structure to which the inner skewed panel is abutted. Another feature of this aspect of the present invention may be that the partial arch-shaped profile of the wedge member matches a corresponding portion of the corresponding arch-shaped profile on the inner skewed panel. Another feature of this aspect of the present invention may be that each of the outer skewed edge and the outer mating edge on the inner skewed panel extend approximately half way across the width the inner skewed panel.

In another aspect, the invention may be a skewed end assembly for connection to an arch culvert structure comprising: an inner skewed panel having an arch-shaped side profile, an inner edge, an outer skewed edge disposed at an angle in relation to the inner edge, an outer mating edge that is generally parallel to the inner edge, and a ledge disposed along the outer mating edge and including a plurality of bore holes; and a wedge member having a partially arch-shaped side profile, an outer skewed edge, an inner mating edge and a lip engageable with the ledge and including a plurality of apertures adapted for alignment with the bore holes in the ledge. Another feature of this aspect of the present invention may be that the invention further includes: a plurality of cylinders disposed within corresponding apertures in the lip; and a plurality of connectors disposed through the cylinders and into the corresponding bore holes in the ledge. Another feature of this aspect of the present invention may be that the invention may further include a plurality of threaded anchors disposed within corresponding bore holes in the ledge, and wherein each connector is a bolt adapted for threadable engagement with a corresponding threaded anchor. Another feature of this aspect of the present invention may be that the outer skewed edge on the inner skewed panel and the outer skewed edge on the wedge member are substantially co-planar when the inner skewed panel and the wedge member are in abutting relationship with the lip engaged to the ledge. Another feature of this aspect of the present invention may be that the inner edge of the inner skewed panel is adapted for abutting a corresponding edge of an arch-shaped culvert section in the arch culvert structure. Another feature of this aspect of the present invention may be that the arch-shaped profile of the inner skewed panel matches a corresponding arch-shaped profile of an arch-shaped culvert section in the arch culvert structure to which the inner skewed panel is abutted. Another feature of this aspect of the present invention may be that the partial arch-shaped profile of the wedge member matches a corresponding portion of the corresponding arch-shaped profile on the inner skewed panel. Another feature of this aspect of the present invention may be that each of the outer skewed edge and the outer mating edge on the inner skewed panel extend approximately half way across the width the inner skewed panel.

In another aspect, the present invention may be a skewed end assembly for connection to an arch culvert structure comprising: an inner skewed panel having an arch-shaped side profile, an inner edge, an outer skewed edge disposed at an angle in relation to the inner edge, an outer mating edge that is generally parallel to the inner edge, and a ledge disposed along the outer mating edge and including a plurality of threaded anchors; and a wedge member having a partially arch-shaped side profile, an outer skewed edge, an inner mating edge and a lip engageable with the ledge and including a plurality of apertures for receiving a plurality of threaded connectors adapted for threadable engagement with the corresponding threaded anchors in the ledge. Another feature of this aspect of the present invention may be that the outer skewed edge on the inner skewed panel and the outer skewed edge on the wedge member are substantially co-planar when the inner skewed panel and the wedge member are in abutting relationship with the lip engaged to the ledge. Another feature of this aspect of the present invention may be that the inner edge of the inner skewed panel is adapted for abutting a corresponding edge of an arch-shaped culvert section in the arch culvert structure and the arch-shaped profile of the inner skewed panel matches a corresponding arch-shaped profile of the abutting arch-shaped culvert section; and the partial arch-shaped profile of the wedge member matches the corresponding arch-shaped profile on the inner skewed panel.

Other features, aspects and advantages of the present invention will become apparent from the following discussion and detailed description.

BRIEF DESCRIPTION OF THE DRAWINGS

FIG. 1 is a perspective view of a specific embodiment of an arch bridge or culvert structure constructed in accordance with the present invention.

FIG. 2 is a top view of one end of the bridge/culvert structure shown in FIG. 1, and showing a more detailed view of how a wedge member is connected to an inner skewed panel.

FIG. 3 is a side view in cross-section taken along line 3-3 of FIG. 2, and showing the manner in which the wedge members are connected to the inner skewed panels.

FIG. 4 is a perspective view of the wedge member that forms a part of each end of the bridge/culvert structure shown in FIGS. 1 and 2.

Figure 5:
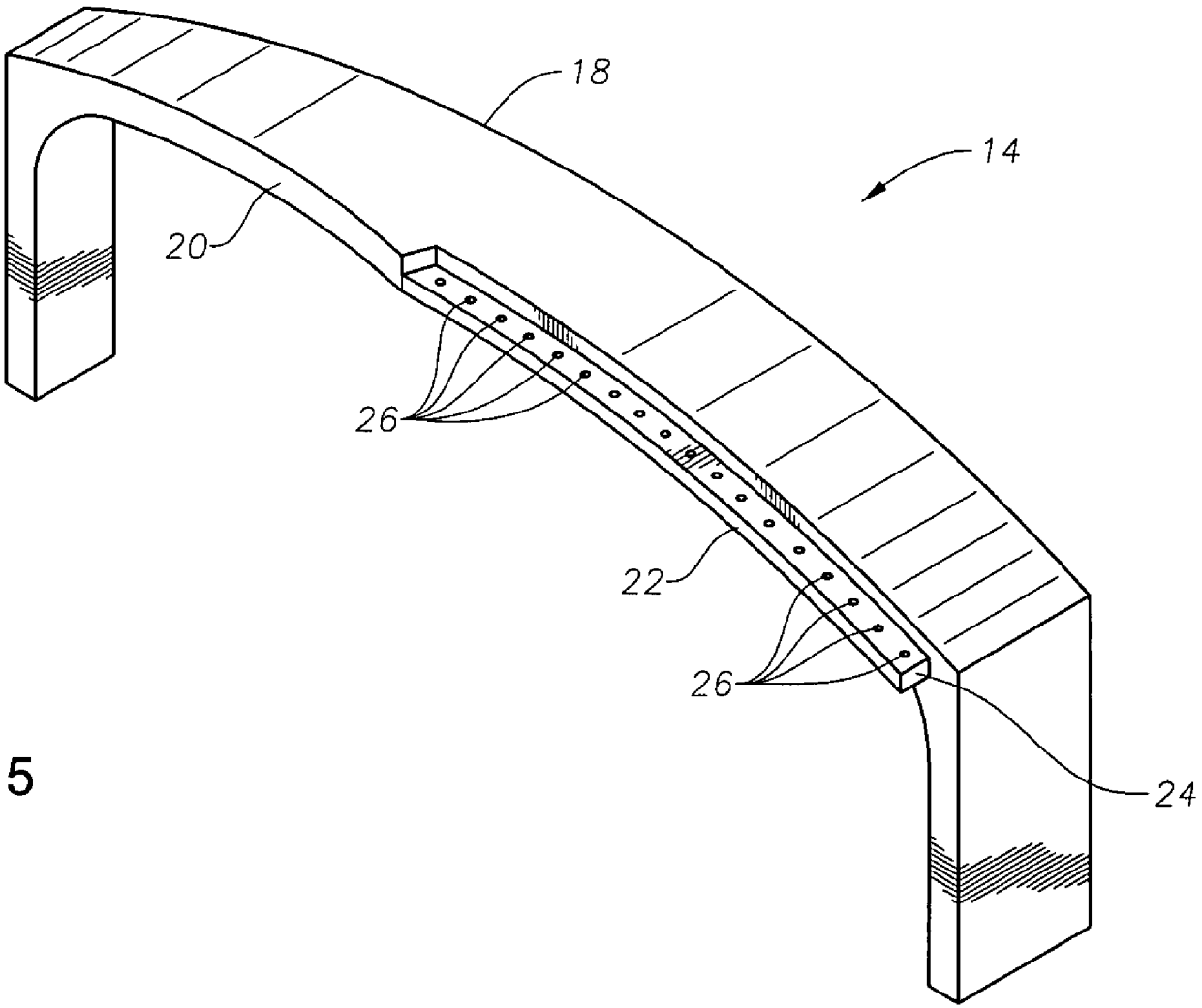
FIG. 5 is a perspective view of an inner skewed panel that forms part of each end of the bridge/culvert structure shown in FIGS. 1 and 2, and that is adapted for engagement with the wedge member shown in FIG. 4.

While the invention will be described in connection with the preferred embodiments, it will be understood that it is not intended to limit the invention to those embodiments. On the contrary, it is intended to cover all alternatives, modifications, and equivalents as may be included within the spirit and scope of the invention as defined by the appended claims.

DETAILED DESCRIPTION OF THE INVENTION

Referring to the drawings in detail, wherein like numerals denote identical elements throughout the several views, there is shown in FIG. 1 a perspective view of a bridge or culvert structure 10 comprised of a plurality of generally uniformly-shaped arch sections 12 disposed between an inner skewed panel 14 and a wedge member 16 situated at each end of the structure 10. The arch sections 12 may be of the type as disclosed in the above-mentioned Lockwood patents.

The inner skewed panel 14 has an arch-shaped side profile matching that of the arch sections 12, but is provided with a different shape when viewed from above. As shown in FIG. 2, each inner skewed panel 14 has: an inner edge 18 adapted for contacting a corresponding edge of the adjacent arch section 12; an outer skewed edge 20 disposed at an angle in relation to the inner edge 18; and an outer mating edge 22 that is generally parallel to the inner edge 18. In a specific embodiment, each of the outer skewed edge 20 and the outer mating edge 22 may extend approximately half way across the width the skewed panel 14. As best shown in FIG. 5, the inner skewed panel 14 is provided with a ledge 24, which, in a specific embodiment, is disposed adjacent the outer mating edge 22. The ledge 24 is preferably provided with a plurality of bore holes 26, the purpose of which will be described below.

As can be seen from FIGS. 1 and 2, the wedge member 16 is approximately one half of the width of the arch sections 12, and thus has a profile that is approximately one half of an arch and which matches the corresponding arch-shaped profile on the inner skewed panel 14 to which it abuts. The wedge member 16 also has an outer skewed edge 28 and an inner mating edge 30. As best shown in FIG. 4, the wedge member 16 is provided with a lip 32, which, in a specific embodiment, is disposed adjacent the inner mating edge 30. The lip 32 is preferably provided with a plurality of apertures 34 adapted for alignment with the bore holes 26 in the ledge 24 of the inner skewed panel 14.

The manner in which each wedge member 16 is connected to its corresponding inner skewed panel 14 will now be described. As shown in FIG. 3, which is a cross-sectional view taken along line 3-3 of FIG. 2, each aperture 34 in the lip 32 on the wedge member 16 is preferably provided with a cylinder 36, such as a section of poly vinyl chloride (PVC) pipe, which may be cast in place when the wedge member 16 is formed. Similarly, each bore hole 26 in the ledge 24 on the inner skewed panel 14 is preferably provided with an anchor 38 having a threaded bore 39. As with the cylinders 36, the anchors 38 are preferably cast in place when the skewed panel 14 is poured. When it is desired to connect the wedge member 16 to its corresponding inner skewed panel 14, the two pieces are positioned adjacent one another such that the lip 32 overlaps the ledge 24 and such that the apertures 34 are aligned with the threaded bore holes 39 in the anchors 38. A bolt 42 is then passed through a washer 44 and then through a cylinder 36 and threaded into the corresponding threaded bore 39. This is repeated for each of the cylinders 36 and anchors 38. FIG. 3 also illustrates that the skewed panel 14 and the wedge member 16 are preferably provided with sections of reinforcing steel bars 40 that are cast in place and extend into the ledge 24 and lip 32 for strengthening purposes. FIG. 3 also illustrates that, in a preferred embodiment, the wedge members 16 and inner skewed panels 14 are connected such that gaps 46 are disposed therebetween to allow for expansion of the precast concrete.

Once connected, as shown in FIGS. 1 and 2, the wedge member 16 and skewed panel 14 are connected to opposite ends of the bridge/culvert structure 10 such that the outer skewed edges 20 and 28 of the skewed panel 14 and the wedge member 16, respectively, are coplanar and cooperate to form skewed or angled ends to the structure 10. As explained above, this structure is desirous when the road design calls for a bridge/culvert structure 10 to be situated at an angle relative to the centerline of the road, as it allows for the skewed ends to be generally parallel to the roadway.

It is to be understood that the invention is not limited to the exact details of construction, operation, exact materials or embodiments shown and described, as obvious modifications and equivalents will be apparent to one skilled in the art. Accordingly, the invention is therefore to be limited only by the scope of the appended claims.

The invention claimed is:

1. A skewed end assembly for connection to an arch culvert structure comprising:

an inner skewed panel having an arch-shaped side profile, an inner edge, an outer skewed edge disposed at an angle in relation to the inner edge, an outer mating edge that is generally parallel to the inner edge, and a ledge; and a wedge member having a partially arch-shaped side profile, an outer skewed edge, an inner mating edge and a lip adapted for engagement with the ledge on the inner skewed panel.

2. The assembly of claim 1, wherein the ledge includes a plurality of bore holes and the lip includes a plurality of apertures adapted for alignment with the bore holes in the ledge, and further including a plurality of connectors disposed through the apertures in the lip and into the corresponding bore holes in the ledge.

3. The assembly of claim 2, further including a plurality of cylinders disposed within corresponding apertures in the lip.

4. The assembly of claim 3, wherein each cylinder is a section of PVC pipe.

5. The assembly of claim 2, further including a plurality of threaded anchors disposed within corresponding bore holes in the ledge, and wherein each connector is a bolt adapted for threadable engagement with a corresponding threaded anchor.

6. The assembly of claim 1, wherein the outer skewed edge on the inner skewed panel and the outer skewed edge on the wedge member are substantially co-planar when the inner skewed panel and the wedge member are in abutting relationship with the lip engaged to the ledge.

7. The assembly of claim 1, wherein the inner edge of the inner skewed panel is adapted for abutting a corresponding edge of an arch-shaped culvert section in the arch culvert structure.

8. The assembly of claim 1, wherein the arch-shaped profile of the inner skewed panel matches a corresponding arch-shaped profile of an arch-shaped culvert section in the arch culvert structure to which the inner skewed panel is abutted.

9. The assembly of claim 1, wherein the partial arch-shaped profile of the wedge member matches a corresponding portion of the corresponding arch-shaped profile on the inner skewed panel.

10. The assembly of claim 1, wherein each of the outer skewed edge and the outer mating edge on the inner skewed panel extend approximately half way across the width the inner skewed panel.

11. A skewed end assembly for connection to an arch culvert structure comprising:

an inner skewed panel having an arch-shaped side profile, an inner edge, an outer skewed edge disposed at an angle in relation to the inner edge, an outer mating edge that is generally parallel to the inner edge, and a ledge disposed along the outer mating edge and including a plurality of bore holes; and a wedge member having a partially arch-shaped side profile, an outer skewed edge, an inner mating edge and a lip engageable with the ledge and including a plurality of apertures adapted for alignment with the bore holes in the ledge.

12. The assembly of claim 11, further including:

a plurality of cylinders disposed within corresponding apertures in the lip; and a plurality of connectors disposed through the cylinders and into the corresponding bore holes in the ledge.

13. The assembly of claim 11, further including a plurality of threaded anchors disposed within corresponding bore holes in the ledge, and wherein each connector is a bolt adapted for threadable engagement with a corresponding threaded anchor.

14. The assembly of claim 11, wherein the outer skewed edge on the inner skewed panel and the outer skewed edge on the wedge member are substantially co-planar when the inner skewed panel and the wedge member are in abutting relationship with the lip engaged to the ledge.

15. The assembly of claim 11, wherein the inner edge of the inner skewed panel is adapted for abutting a corresponding edge of an arch-shaped culvert section in the arch culvert structure.

16. The assembly of claim 11, wherein the arch-shaped profile of the inner skewed panel matches a corresponding arch-shaped profile of an arch-shaped culvert section in the arch culvert structure to which the inner skewed panel is abutted.

17. The assembly of claim 11, wherein the partial arch-shaped profile of the wedge member matches a corresponding portion of the corresponding arch-shaped profile on the inner skewed panel.

18. The assembly of claim 11, wherein each of the outer skewed edge and the outer mating edge on the inner skewed panel extend approximately half way across the width the inner skewed panel.

19. A skewed end assembly for connection to an arch culvert structure comprising:

an inner skewed panel having an arch-shaped side profile, an inner edge, an outer skewed edge disposed at an angle in relation to the inner edge, an outer mating edge that is generally parallel to the inner edge, and a ledge disposed along the outer mating edge and including a plurality of threaded anchors; and a wedge member having a partially arch-shaped side profile, an outer skewed edge, an inner mating edge and a lip engageable with the ledge and including a plurality of apertures for receiving a plurality of threaded connectors adapted for threadable engagement with the corresponding threaded anchors in the ledge.

20. The assembly of claim 19, wherein the outer skewed edge on the inner skewed panel and the outer skewed edge on the wedge member are substantially co-planar when the inner skewed panel and the wedge member are in abutting relationship with the lip engaged to the ledge.

* * * * *